US005170653A

United States Patent [19]

Lastowski et al.

[11] Patent Number: 5,170,653

[45] Date of Patent: Dec. 15, 1992

[54] METHOD FOR COILING TWIST FREE STEEL BARS

[75] Inventors: George R. Lastowski, West Seneca, N.Y.; John I. Crichton, Fort Erie, Canada

[73] Assignee: Bethlehem Steel Corporation, Bethlehem, Pa.

[21] Appl. No.: 579,122

[22] Filed: Sep. 7, 1990

[51] Int. Cl.[5] ..... B21B 39/20; B21C 47/02; B65H 20/00

[52] U.S. Cl. ..... 72/251; 242/82; 226/181

[58] Field of Search ..... 72/14, 135, 206, 250, 72/251; 140/2; 242/82, 83; 226/176, 181

[56] References Cited

U.S. PATENT DOCUMENTS

| | | | |
|---|---|---|---|
| 1,822,589 | 9/1931 | George et al. | 72/135 |
| 1,987,324 | 1/1935 | Catterall et al. | 72/252.5 |
| 2,135,729 | 11/1938 | Olgay | 72/14 |
| 2,567,537 | 9/1951 | Workman | 72/135 |
| 2,900,073 | 8/1959 | Blake et al. | 72/160 |
| 3,028,114 | 4/1962 | Asbeck | 72/14 |
| 3,270,978 | 9/1966 | Whiteacre | 242/82 |
| 3,395,560 | 8/1968 | Cofer et al. | 242/83 |
| 3,599,891 | 8/1971 | Stone | 242/82 |
| 3,785,587 | 1/1974 | Meyfarth et al. | 242/159 |
| 3,873,040 | 3/1975 | Sieurin | 242/82 |
| 4,109,879 | 8/1978 | Properzi | 242/82 |
| 4,133,035 | 1/1979 | Grohowski et al. | 364/472 |
| 4,413,494 | 11/1983 | Gilvar et al. | 72/14 |
| 4,944,469 | 7/1990 | Wilson | 242/82 |

FOREIGN PATENT DOCUMENTS

| | | | |
|---|---|---|---|
| 2535390 | 2/1977 | Fed. Rep. of Germany | 72/14 |
| 139417 | 8/1982 | Japan | 72/14 |
| 216812 | 9/1986 | Japan | 72/14 |

*Primary Examiner*—Lowell A. Larson
*Assistant Examiner*—Thomas C. Schoeffler
*Attorney, Agent, or Firm*—John I. Iverson

[57] ABSTRACT

Disclosed is a method of coiling steel bars, especially hexagonal bars, with a twist free coil in a continuous rolling mill equipped with pouring reels. Disclosed is the use of pinch rolls to prevent the twisting of the bar as it is being coiled.

2 Claims, 1 Drawing Sheet

METHOD FOR COILING TWIST FREE STEEL BARS

BACKGROUND OF THE INVENTION

This invention relates to a method for collecting and coiling steel bars or the like at the finishing end of a continuous operating bar mill. It relates particularly to the collecting and coiling of hexagonal steel bars after they are rolled on a continuous operating bar mill.

In modern continuous operating bar mills after the bar is rolled to size it is coiled while hot into a tub to form a continuous coil of bar suitable for shipping to the customer. It has been observed that during the coiling of hot hexagonal bar, the bar would develop a severe torsional twist during the coiling operation. Upon delivery of the cold coil to the customer the twist was permanent and made the bar difficult to process further.

SUMMARY OF THE INVENTION

It is therefore an object of this invention to provide a method of preventing the twisting of lengths of hot hexagonal steel bar during the coiling of hot bar into coils.

It is a further object of this invention to provide a method of preventing the twisting of lengths of hot hexagonal steel bar that is easily adapted to conventional bar coiling equipment.

I have discovered the foregoing objects can be attained by having the pinch rolls usually used to move the tail end of the bar engage the entire length of the bar as it is being coiled.

DESCRIPTION OF A PREFERRED EMBODIMENT

Figure 1:
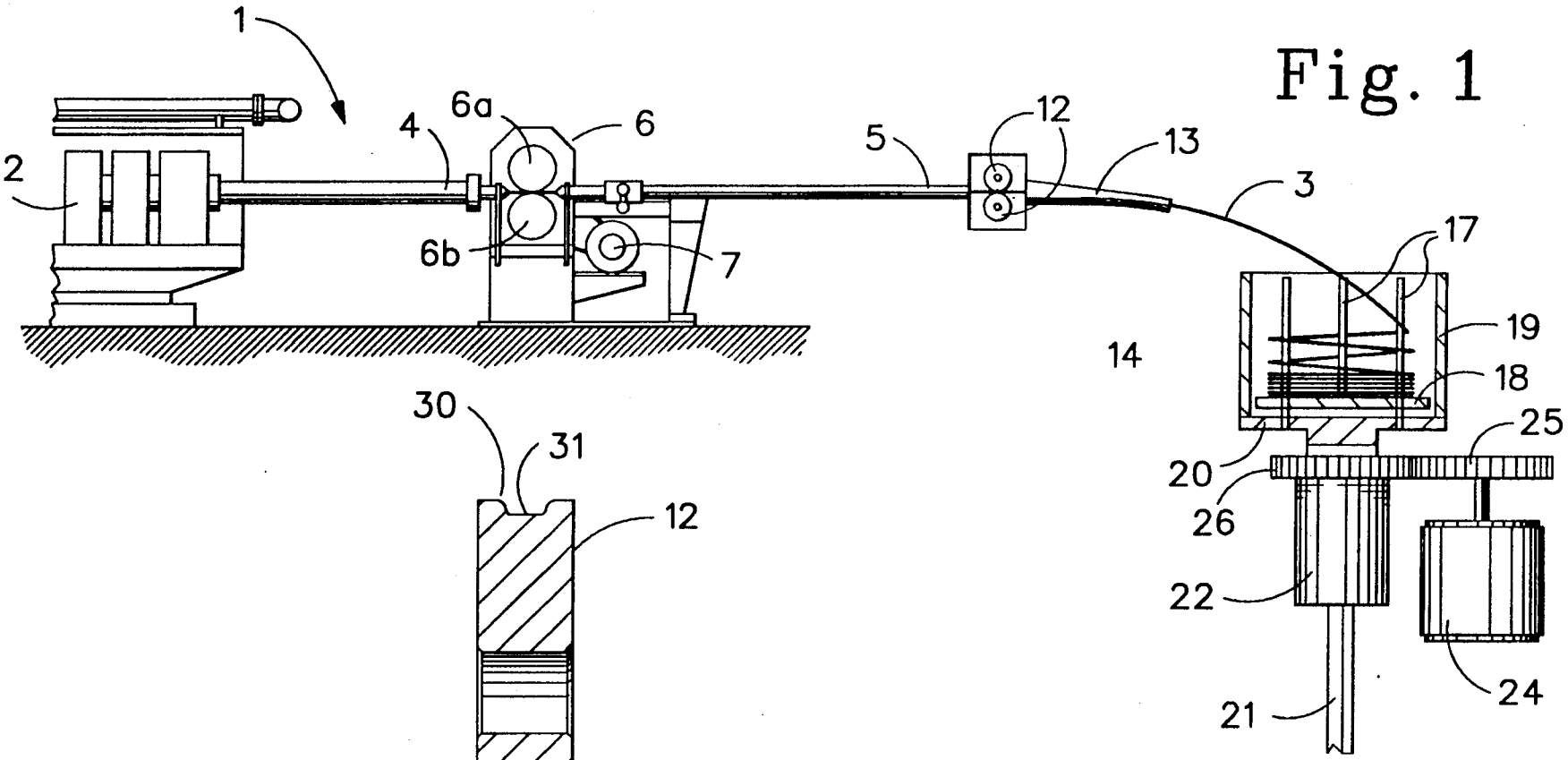
FIG. 1 is a side elevational view of an apparatus used to practice this invention.

Referring to FIG. 1, rolling mill 1 is comprised of a successive series of roll sets or groups 2 which shape a continuous length of steel into an elongated bar 3 of proper dimensions. The bars 3 are usually round but most rolling mills also produce bars of other cross sectional shapes, such as a hexagon for particular applications of the customer.

The hot, finished bar 3 is supported by a first guide section 4 and a second water filled guide section 5 which are positioned horizontally as shown in FIG. 1. Between the two guide sections 4 and 5 is a flying shear 6 having rotating blades 6(*a*) and 6(*b*) to cut the bar to a desired length as it passes through the shear 6. The shear blades 6(*a*) and 6(*b*) are rotated by a motor 7 mounted on the shear 6.

As the bar 3 exits the water filled guide tube 5, it passes between a pair of pinch rolls 12 and then into a guide nozzle 13 which directs the rod into a pouring reel 14. Pins 17 are attached inside reel 14 to provide an inner or minimum radius for the formation of coil of bar 3 in reel 14. The reel 14 comprises a coil plate 18, sidewall 19 defining the outer radius of the coil, base plate 20 and pins 17 mounted on a vertical shaft 21 which rides in a fixed bearing 22. The reel 14 is rotated about a vertical axis by motor 24 through a pinion 25 and gear 26.

Figure 2:
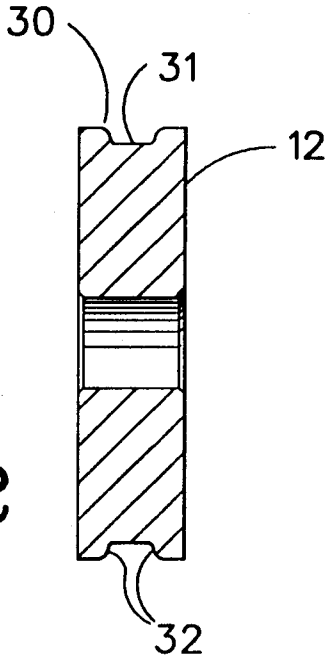
FIG. 2 is a section of the pinch roll used in the apparatus to practice this invention.

FIG. 2 illustrates a pinch roll 12 for use in coiling a hexagon bar according to this invention. The bar recess 30 has a generally flat bottom 31 and inclined sidewalls 32 which diverge from each other at an angle of about 60°. Pinch rolls 12 are driven by a motor (not shown) and can be moved towards or away to engage or disengage from the bar 3 by hydraulic linkage.

The pinch rolls 12 are normally closed on the bar 3 only after the tail end of the bar 3 has been cut by shear 6. The pinch rolls 12 pull and push the tail end of the bar into the pouring reel 14.

In coiling bars of a hexagonal cross section it was determined that nozzle 13 would impart a torsional twist into the hot bar 3 at it was being coiled. This twist is objectionable in the further processing of the bars by the customer. It was determined that the twist was caused by the relatively free movement of the bar 3 in the guide tube 5 and nozzle 13.

The twisting of the bar 3 during coiling has been eliminated by causing the pinch rolls 12 to grasp the entire length of the bar 3 instead of just the tail end of the bar after it has been sheared. The controls of the motor driving the pinch rolls and pneumatic linkage are set so that pinch rolls 12 now engage the bar 3 at the head end and drive the entire length of the bar 3 through the nozzle 13. The bar 3 being held entirely by the pinch rolls is no longer free to twist. It is desirable to increase the pressure of the pinch rolls 12 on the bar 3 when the tail end of the bar 3 is sheared to provide sufficient power to coil the tail end of the bar 3 into the pouring reel 14.

The advantage of this invention is not only a twist free bar but the only changes required to implement this invention are simple modifications to the pinch roll drive and assembly and a new shape to the pinch roll recess 30 to insure that the hexagonal bar does not rotate while being held by the pinch rolls 12.

We claim:

1. A method for preventing the twisting of a hot rolled steel hexagonal bar at the outlet of a rolling mill where the bar is deposited into a substantially horizontal coil by holding a portion of the outer surface of such bar against rotation between a pair of powered pinch rolls positioned upstream of said coil for the entire length of said bar.

2. The method of claim 1 in which the pressure of the pinch rolls against the outer surface of said bar is increased as the tail end of the bar passes through said pinch rolls.

* * * * *